United States Patent [19]

Maezawa et al.

[11] 4,406,551

[45] Sep. 27, 1983

[54] ELECTRIC NUMBERING MACHINE

[75] Inventors: Osamu Maezawa; Yusuke Saitho; Koichi Tominaga, all of Tokyo, Japan

[73] Assignee: Kabushiki Kaisha Gakushu Kenkyusha (Gakken Co., Ltd.), Tokyo, Japan

[21] Appl. No.: 304,188

[22] Filed: Sep. 21, 1981

[30] Foreign Application Priority Data

Dec. 8, 1980 [JP] Japan ..... 55-176591[U]
Dec. 8, 1980 [JP] Japan ..... 55-176592[U]

[51] Int. Cl.[3] ..... B41J 1/24

[52] U.S. Cl. ..... 400/163.2; 400/161.2; 101/93.17

[58] Field of Search ..... 400/88, 29, 30, 144.3, 400/380, 161–162.3, 163.1–163.3; 101/110, 93.15, 93.17, 103, 72–79

[56] References Cited

U.S. PATENT DOCUMENTS

| | | | |
|---|---|---|---|
| 2,801,583 | 8/1957 | Loushay | 101/72 X |
| 3,168,182 | 2/1965 | Bernard et al. | 101/93.17 X |
| 3,504,622 | 4/1970 | Morrison | 101/110 X |
| 3,524,406 | 8/1970 | Traynor | 101/110 X |
| 3,908,809 | 9/1975 | Beattie | 400/144.3 |
| 4,013,005 | 3/1977 | Keefe | 101/110 |
| 4,095,686 | 6/1978 | Okabe | 101/110 |
| 4,216,715 | 8/1980 | Sato | 101/103 |
| 4,244,291 | 1/1981 | Kodaira et al. | 101/93.17 X |

FOREIGN PATENT DOCUMENTS

| | | | |
|---|---|---|---|
| 2046671 | 11/1980 | United Kingdom | 400/88 |

*Primary Examiner*—Edward M. Coven
*Attorney, Agent, or Firm*—Irving M. Weiner; Pamela S. Burt; John L. Shortley

[57] ABSTRACT

An electric numbering machine which continuously prints a number of large figures by use of a single figure wheel, is compact in size, and reduces the printing operation time. A case of the machine is provided therein with a shaft interposed between a pair of support plates rocked by operation of a solenoid, and rotated by a pulse motor; a figure wheel fitted to the shaft to rotate integrally with same; a ratchet intermittently rotated by operation of the solenoid via a feed mechanism; a brake pawl cooperating with the ratchet to restrict return rotation of the ratchet; a drum cooperating with the ratchet to rotate integrally therewith; and a tensile member having one end fixed to the drum and the other end fixed to a support of the figure wheel. The figure wheel is moved by the tensile member one figure at a time along the shaft against resiliency of an elastic member, and a release member is provided so as to release engagement of the feed mechanism and the brake pawl with the ratchet so as to return the figure wheel to the start position thereof after rocking and movement of the figure wheel is repeated to print the number of digits of predetermined figures and after printing is complete. Various buttons including figure buttons for inputting and setting the number to be printed and instruction buttons for generating various print instructions are disposed on the case.

5 Claims, 29 Drawing Figures

ELECTRIC NUMBERING MACHINE

BACKGROUND OF THE INVENTION

1. Field of the Invention

The present invention relates to an electric numbering machine, and particularly to an electric hand numbering machine, which makes it possible to continuously print a number of large figures by use of a single figure wheel.

2. Description of Relevant Art

Conventional hand numbering machines are primarily of a manual operation type. A numbering machine of such type includes a figure wheel for each digit of a number to be printed and the figure wheels must be manually set to the first number to be printed. The machine is then positioned on a portion of a sheet of paper to be printed and a push rod disposed at an upper portion of the machine is pushed down to effect printing. This operation is repeated for each sheet to print continuous numbers. Because setting of the first number to be printed must be performed manually, operation of the machine is time-consuming and troublesome. Further, if printing is effected on a great number of sheets, the number of push-down operations increases correspondingly. Because the push-down force required for such operations is substantial, the operator of the machine becomes fatigued. For these reasons, a desideratum has developed among users of numbering machines for a small electric hand numbering machine which replaces the conventional manual numbering machine.

Various electric hand numbering machines have been proposed in order to satisfy the aforesaid desideratum, however, such machines include a figure wheel for each figure of a number and merely automate the push-down operation.

The present invention overcomes the aforesaid problems attendant conventional hand numbering machines.

SUMMARY OF THE INVENTION

The present invention provides an electric hand numbering machine comprising a case having provided therein: a shaft interposed between a pair of support plates rocked by operation of a solenoid, and rotated by a pulse motor; a figure wheel fitted to the shaft and rotating integrally therewith; a ratchet intermittently rotated by operation of the solenoid via a feed mechanism; a brake pawl operatively cooperating with the ratchet so as to restrict return rotation thereof; a drum operatively cooperating with the ratchet so as to rotate integrally therewith; a tensile member having one end thereof fixed to the drum and the other end thereof fixed to a support of the figure wheel; the figure wheel being moved by the tensile member one figure at a time along the shaft against resiliency of an elastic member fitted to the support; and a release member adapted to release engagement of the feed mechanism and the brake pawl with the ratchet in order to return the figure wheel to the start position thereof. Such return of the figure wheel to the start position thereof is effected after rocking and movement of the figure wheel is repeated to print the number of digits of the predetermined figures and after printing is finished.

It is an object of the present invention to provide an electric hand numbering machine which makes it possible to set a first number to be printed with great ease, whatever it may be; to effect the printing operation by use of one solenoid; and to reduce the printing operation time as much as possible in comparison with the conventional manual numbering machine.

It is another object of the present invention to provide an electric hand numbering machine which is compact in size as a whole, which makes it possible to carry out the printing operation extremely easily and which is easy to handle by placing the aforesaid components in one case. In accordance with the invention, figure buttons for inputting and setting the number to be printed, instruction buttons for generating various print instructions, and the like, are disposed on the case. Also, an instruction button having the highest frequency of use is disposed at the upper end of a swelled portion of the case.

A further object of the present invention is to provide an electric hand numbering machine which is capable of reliably transmitting the driving force of the aforesaid pulse motor even when the figure wheel rocks, by bringing the shaft of the pulse motor and the center of rotation of the rocking support plates into alignment with each other.

It is still another object of the present invention to provide an electric hand numbering machine which is capable of maintaining the print surface of the figure wheel in parallel with the surface of the paper to be printed so as to reliably prevent non-uniform printing and to provide clear printing by fitting a gear which rotates minutely in accordance with the rocking angle of the support plates to the shaft of the figure wheel.

It is still another object of the present invention to provide an electric hand numbering machine which is capable of adjusting the gaps between the figures of the number to be printed, by use of a construction in which a rotary drum, which moves the figure wheel one figure at a time and to which one end of the aforesaid tensile member is fixed, is formed to have a shape with multiple stages so as to take up the tensile member thereon.

It is a further object of the present invention to provide an electric hand numbering machine in which the aforesaid figure wheel comprises a figure wheel main body and detachable print members in order to facilitate replacement of the print members upon non-uniform abrasion thereof, or the like.

It is still another object of the present invention to provide an electric hand numbering machine wherein an ink roller device provided for the figure wheel is detachable from the numbering machine and an ink roller is brought into resilient contact with the figure wheel so as to eliminate shortage of ink and to provide clear print.

The above and further objects, details and advantages of the present invention will become more apparent from the following detailed description, when read in conjunction with the accompanying drawings.

DETAILED DESCRIPTION OF PREFERRED EMBODIMENTS

Figure 1:
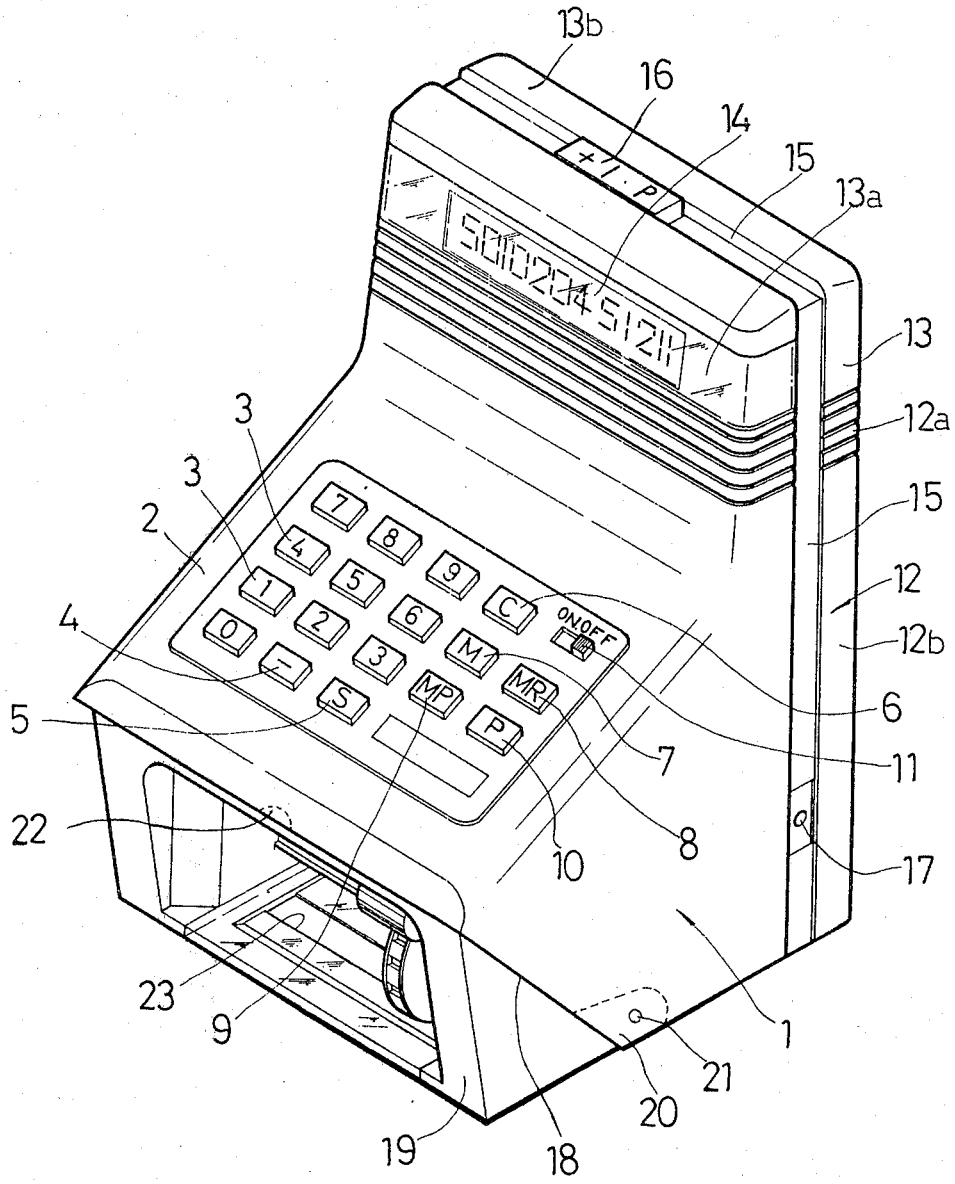
FIG. 1 is a perspective view of an electric hand numbering machine in accordance with the present invention.

With reference to FIG. 1, there is shown a case 1 having an upper face 2 which is inclined forwardly and downwardly. On the upper surface 2 are disposed figure buttons 3, 3, . . . for setting and inputting the first number to be printed; a button 4 for inputting a hyphen; a space button 5 for use when it is desired to define a space between the figures of the number to be printed; a clear button 6; a memory button 7 for inputting the set number to a memory circuit; a button 8 for recalling the memorized number; an instruction button 9 for generating an instruction to print the memorized number as the first number; an instruction button 10 for generating an instruction to merely print the set number; and an ON-OFF switch 11.

A swelled portion 13 is swelled upwardly from the rear part 12 of the case so as to continue from the case upper face 2, and thus provides for easy gripping of the case. A plurality of protuberances 12*a* are formed around swelled portion 13 to prevent the case from slipping when an operator grips swelled portion 13. A display portion 14 is disposed above the protuberances 12*a* on the front surface 13*a* of the swelled portion 13 in order to display the set number by means of a photoelectric display or a liquid crystal. A groove 15 is formed on the upper surface 13*b* of the swelled portion 13 so as to extend continuously down the side surface 12*b* of the rear case portion 12. A print instruction button 16 is formed inside the groove 15 on the upper surface 13*b* of the swelled portion 13 so that the tip thereof projects considerably. An AC adaptor connection hole 17 is formed at the lower part of the groove 15 formed on the side surface 12*b* of the rear case portion 12.

The aforesaid print instruction button 16 is connected to a circuit which performs the printing operation when the button 16 is depressed, and increases the set number one by one as each printing operation is effected. Accordingly, when the first print number is set by the aforesaid number buttons 3, 3, . . . and the print instruction button 16 is continuously depressed a plurality of times, the number is increased by one each time the button is depressed.

The print instruction button 16 is larger in size than the various buttons arranged on the upper case surface 2 in order to facilitate pressing thereof.

The front edge portion of case 1 is provided with an opening 18 which opens so as to slant downwardly, and the lower lid member 19 pivots at 21 by means of an arm 20 extending rearwardly to thereby open and close the opening 18. An anchor portion 22 is formed at the upper end portion of the lower lid member 19 to keep the opening 18 closed. Another opening 23 is formed in the lower surface of the lower lid member 19 so that when the numbering machine is placed on the paper, the sheet surface faces the opening 23.

When the lower lid member 19 is rotated in a counterclockwise direction in FIG. 1 above pivot 21, the opening 18 formed at the front end portion of the case is exposed, whereby replacement of an ink roller or the like can be easily effected.

Figure 2:
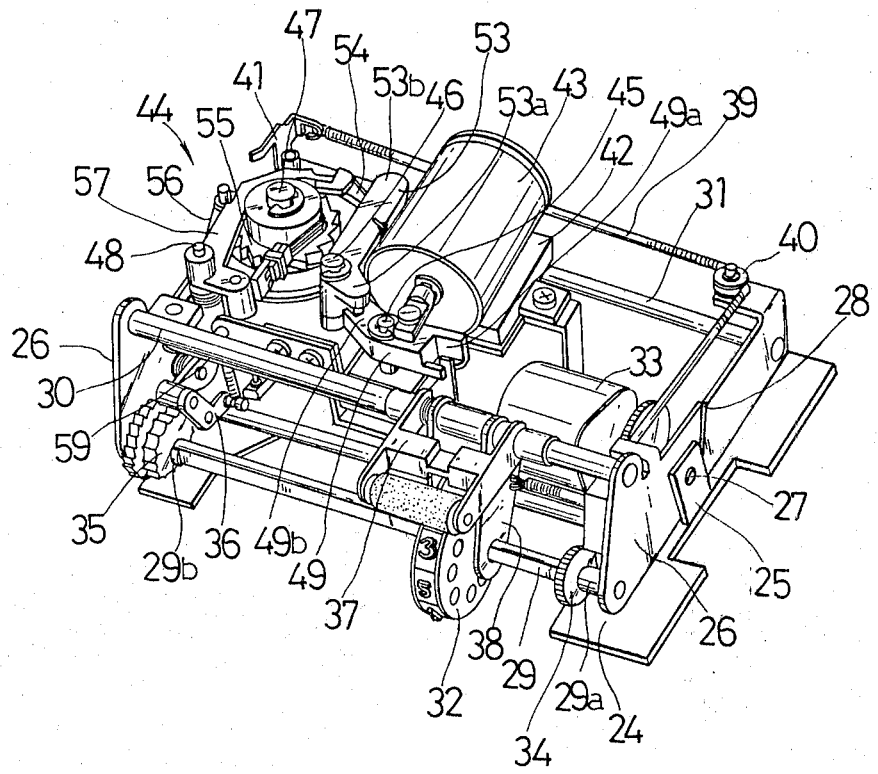
FIG. 2 is a perspective view of an internal mechanism of the numbering machine according to the invention.

FIG. 2 shows the internal mechanism of the numbering machine in accordance with the first embodiment of the invention. Support brackets 25 are mounted on both sides of a base plate 24 and a support plate 26 is rockably pivoted at 27 to each support plate 26 bracket 25. The support plate 26 is urged by a spring 28 so that its forward end is urged upwardly and its rearward end downwardly. Horizontal shafts 29, 30 are disposed between the pair of support plates 26, 26 at the forward end portions thereof, and another horizontal shaft 31 is disposed between support plates 26, 26 at the rearward end portions thereof. The shaft 29 disposed at the lower part of the forward end portions of plates 26, 26 is formed to have a square shape and is rotatably mounted. A figure wheel 32 is fitted to square shaft 29 so as to rotate integrally with shaft 29, and can slide in the transverse direction along shaft 29. A gear 34 is fitted to one end 29*a* of square shaft 29 in order to transmit the rotation of a pulse motor 33, while a gear 35 is fitted to the driven the other end 29*b* of square shaft 29 in order to correct the figure wheel strike angle by rotating the figure wheel 32 slightly. A link mechanism 36 is interposed between gear 35 and the support plate 26, the mechanism 36 slightly rotating the gear 35 in accordance with the support plate 26 rocking angle.

An ink roller 37 and a figure wheel support 38 are fitted to the horizontal shaft 30, and the tip of support 38 is loosely fitted to the square shaft 29. One end of a string-like coiled spring 39 is fixed to one side surface of the support 38 while the other is fixed to a bracket 41 which is fixed to the base plate 24 via a pulley 40.

Figure 3:
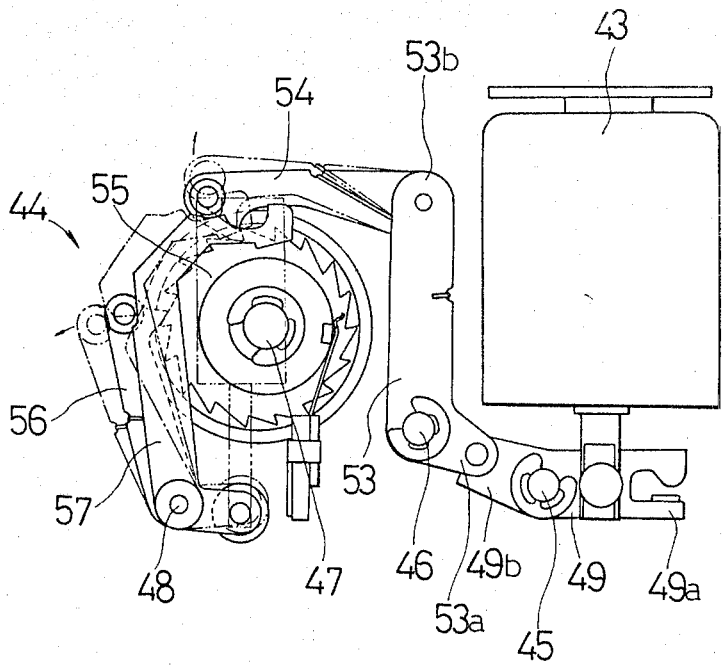
FIGS. 3 and 4 are plan views of a feed mechanism.
Figure 4:
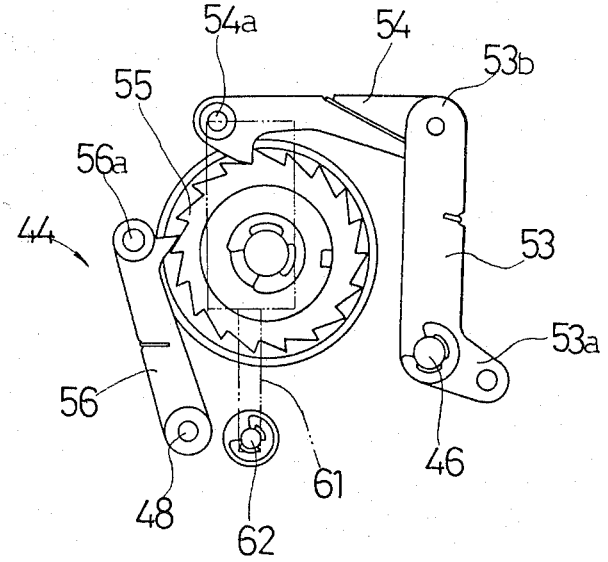
Figure 5:
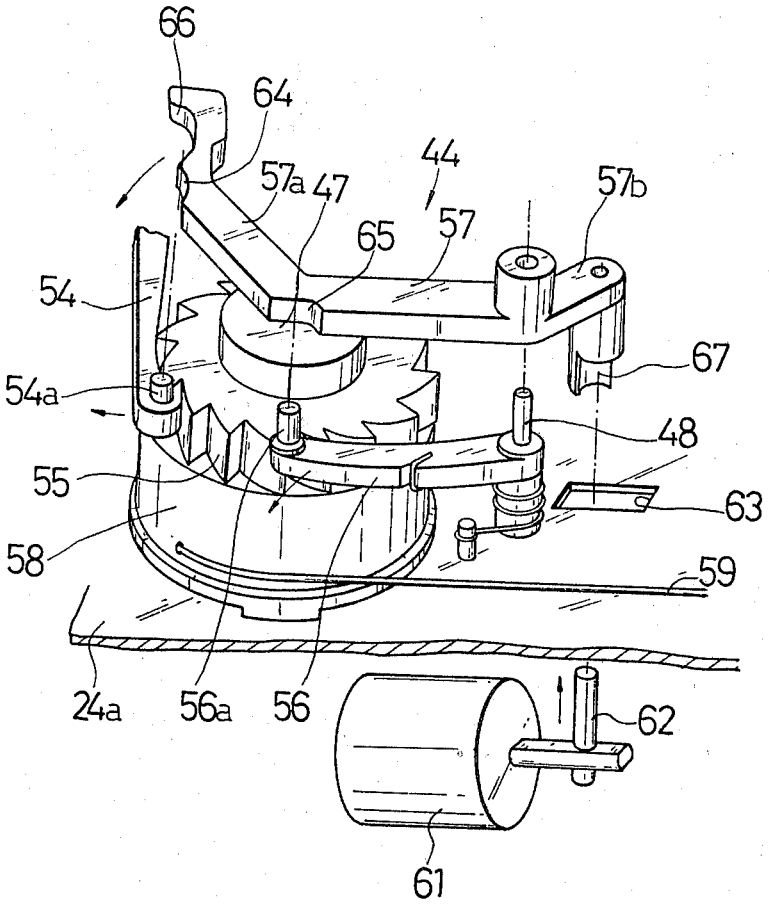
FIG. 5 is an exploded perspective view of the feed mechanism.
Figure 6:
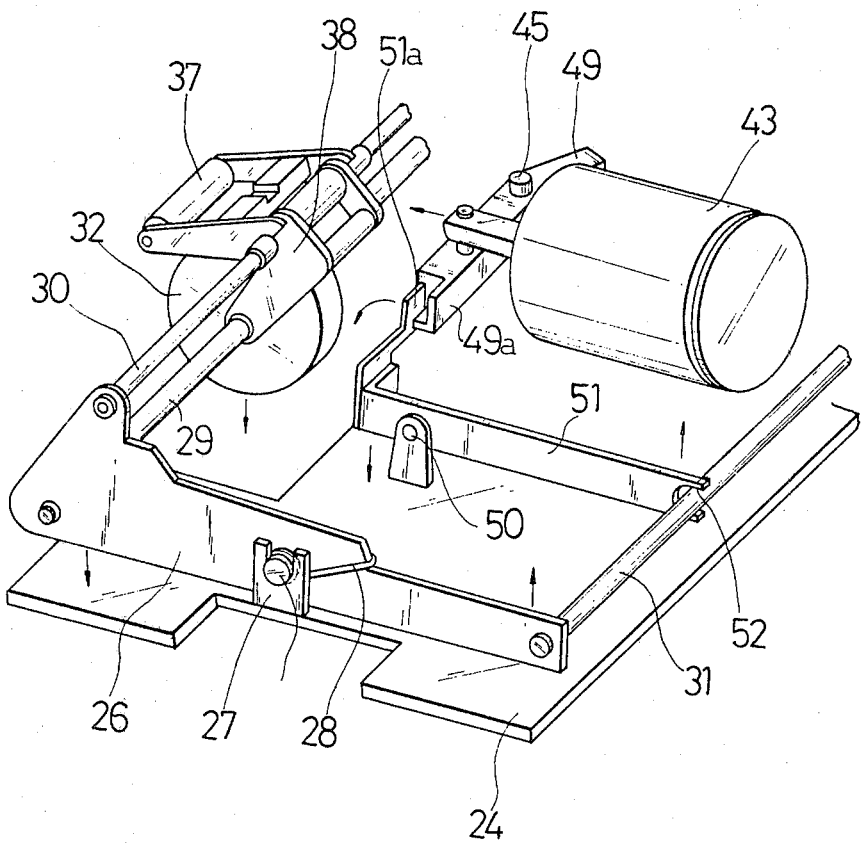
FIG. 6 is a perspective view of a mechanism for rocking support plates.

At the center of base plate 24 is disposed a support table 42, on which a first solenoid 43 is fixed. A feed mechanism for the figure wheel is disposed on an intermediate base plate 24*a* (FIG. 5), which is higher than base plate 24, and substantially adjacent the first solenoid 43. As shown in FIGS. 3 through 5, the feed mechanism 44 comprises various members which pivot on support poles 45, 46, 47, 48 fixed to the intermediate base plate 24*a*. A first lever 49 pivots on support pole 45, and is connected to the shaft of the solenoid 43 so as to rotate as the shaft moves in and out. As shown in FIG. 6, at one end 49*a* of lever 49 is idly fitted the tip of an operation plate 51*a*. The plate 51*a* is fixed to one end of a lever 51 rockably pivoted at 50 on the base plate 24. A recess 52 is formed at the other end of lever 51 and engages with the aforesaid horizontal shaft 31.

A second lever 53 (FIGS. 3 and 4) pivots on support pole 46, and one end 53*a* of lever 53 engages with the other end 49*b* of the first lever 49, while the other end 53*b* of lever 53 is pivoted to a feed pawl 54. The feed pawl 54 advances when the shaft of the first solenoid 43 projects, and retreats when the latter retracts, thereby rotating a ratchet 55 fitted to support pole 47. A brake pawl 56 is pivoted to support pole 48 in order to restrict the return rotation of ratchet 55. The feed pawl 54 and the brake pawl 56 are constantly urged by springs to engage with the ratchet 55. Further, a release lever 57 pivots on support pole 48 in order to simultaneously release the engagement of both brake pawl 56 and feed pawl 54 with the ratchet 55. The lower half of the ratchet 55 is formed as a drum 58 (FIG. 5) and one end of a wire 59 acting as a tensile member is fixed to drum 58, while the other end of wire 59 is fixed to the support 38 of figure wheel 32 via a pulley 60 therebetween.

As shown in FIG. 5, a second solenoid 61 is disposed below the intermediate base plate 24*a* and an operation rod 62 is fixed to the shaft of solenoid 61 so that it projects upwardly through an elongated hole 63 bored in the intermediate base plate 24*a* in the proximity of support pole 48.

The release lever 57 has respective long and short arms extending from the pivotal portion thereof, with the elongated arm 57*a* thereof curving along the outer circumference of the ratchet. The intermediate portion of elongated arm 57*a* is formed with recesses 64, 65 to which the pins 54*a*, 56*a* at the tips of feed pawl 54 and brake pawl 56 fit, respectively, and the tip of elongated arm 57*a* is upwardly bent to form a recess 66. The length of the short arm 57*b* of release lever 57 is such that the tip thereof is positioned substantially above the elongated hole 63, and a sheet-like plate 67 is suspended from the lower part of such tip so as to contact the tip of the operation rod 62 fixed to the second solenoid 61.

When the shaft of the second solenoid 61 retracts, the release lever 57 is rotated by operation rod 62, thereby releasing the engagement of both feed pawl 54 and brake pawl 56 with the ratchet 55.

Figure 7:
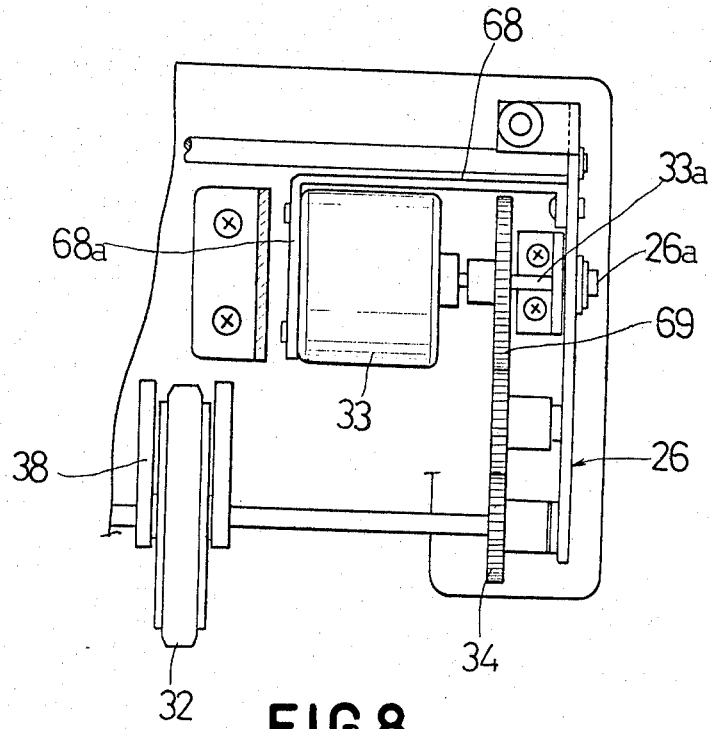
FIG. 7 is a plan view of a mechanism for rotating the figure wheel.
Figure 8:
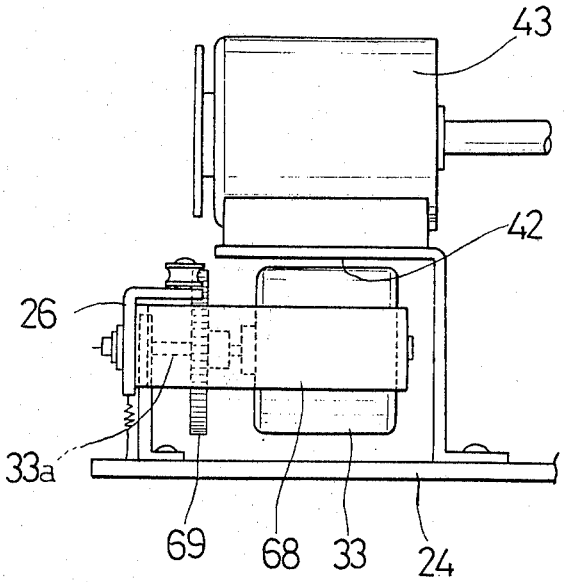
FIG. 8 is a side view of the mechanism for rotating the figure wheel.
Figure 9:
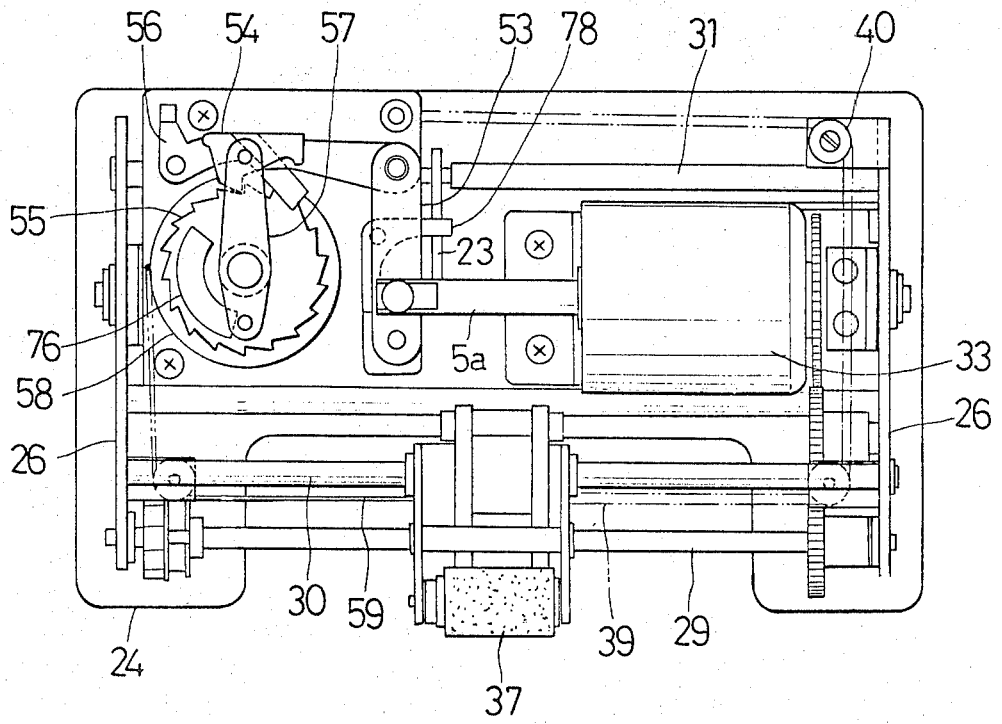
FIG. 9 is a plan view of the internal mechanism in accordance with a second embodiment of the present invention.
Figure 10:
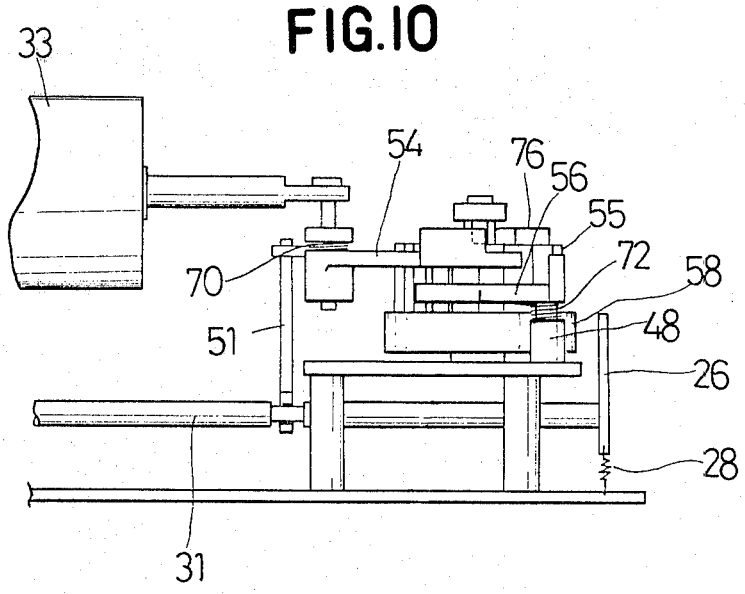
FIG. 10 is a side view of the feed mechanism in accordance with the second embodiment of the invention.
Figure 11:
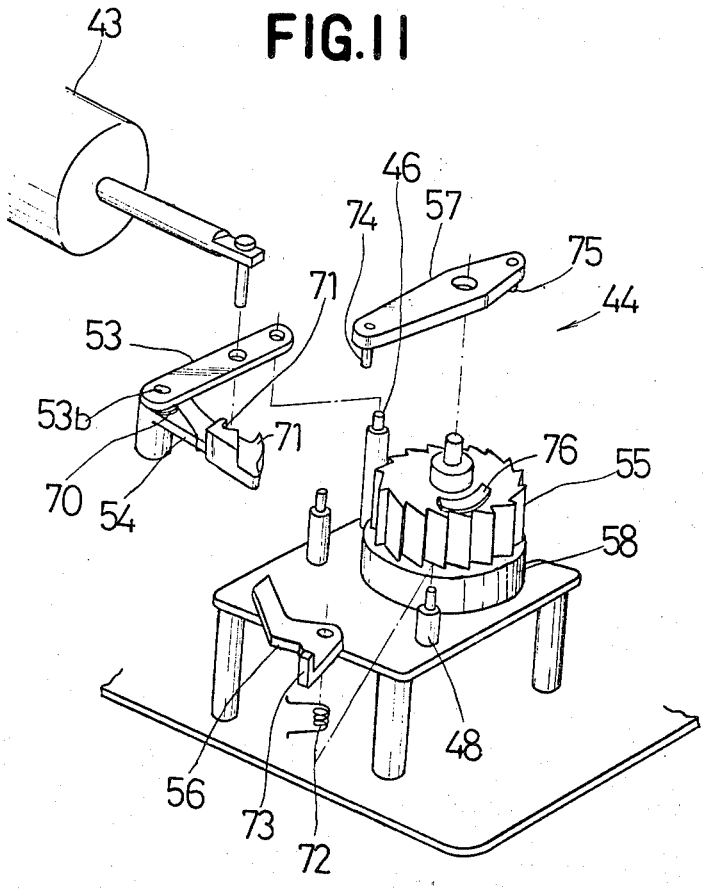
FIG. 11 is an exploded perspective view of the feed mechanism in accordance with the second embodiment of the invention.

As shown in FIGS. 7 and 8, the pulse motor 33 for rotating the figure wheel 32 is disposed on a fitting plate 68 fixed directly to the support plate 26. The rear end of the pulse motor 33 is fixed to a bend portion 68*a* at a rear part of the fitting plate 68. The driving shaft 33*a* of the pulse motor 33 is loosely fitted at its tip into, and is supported by, a hole formed at the center of rocking 26*a* of the support plate 26. A gear train 69 transmits the rotation of the pulse motor 33 to the gear 34 fitted to the shaft 29.

As described hereinabove, the pulse motor 33 is fitted directly to the support plate 26 by means of the fitting plate 68 and the tip of the driving shaft 33*a* of pulse motor 33 is loosely fitted into, and supported by, the hole bored in the support plate 26. Accordingly, no deviation occurs between the gears of the gear train 69, and the power of the pulse motor 33 can be reliably transmitted to the figure wheel 32.

The driving shaft 33*a* of the pulse motor 33 and the center of rocking 26*a* of the support plate 26 are brought into alignment with each other in order to minimize changes in the position of the pulse motor 33 due to rocking of the support plate 26. With such arrangement, it is possible to minimize oscillation, impact, and the like applied to the pulse motor 33, and to enhance its durability.

The operation of the above-described first embodiment of the invention is comprised primarily of four operations. The first of such operations is to rotate the figure wheel 32 by the pulse motor 33 in accordance with the set number, and the second operation is to rock the figure wheel 32 in the vertical direction to print the number on the paper. The third operation is to intermittently move the figure wheel 32 in accordance with each figure of the number, and the fourth operation is to return the figure wheel 32 to its original position after printing of the number of predetermined figures is complete.

The aforesaid four operations will be described in succession hereinbelow. It will be assumed that the number "123" is to be printed once. First, from amongst the figure buttons 3, 3 . . . , the buttons corresponding to the figures "1", "2" and "3" are depressed in order, thereby setting and inputting the number "123". In this case, the display portion 14 displays the number "123".

Next, when the print instruction button 10 is depressed, the pulse motor 33 is rotated by an angle corresponding to the number of the first figure "3", according to the pulse signal and this rotation is transmitted to the square shaft 29 via the gear 34, whereupon the figure wheel 32 is rotated so that the print portion having the first figure "3" comes to the lowermost position. Substantially at the same time, the shaft of the first solenoid 43 projects to thereby rotate the first lever 49 in the clockwise direction in FIG. 2 and the operation plate 51*a* rotates forwardly downwardly as indicated by the arrow in FIG. 6. Consequently, the lever 51, which is integrally fixed to the operation plate 51*a*, rocks in the counter-clockwise direction and the horizontal bar 31 engaging with the recess 52 of the lever 51 moves upwardly. Along with this movement, the support plates 26, 26 rock about shaft 27 and the rear end portions thereof move upwardly. As a result, the figure wheel 32 fitted to the shaft 29 moves downwardly and prints the number of the first figure "3" on the sheet surface. Concurrently with this operation, the second lever 53 interconnected to the other end 49*b* of the first lever 49 rotates in the counter-clockwise direction in FIG. 2 and due to this rotation, the feed pawl 54 advances and engages with the pawl of the ratchet 55.

Next, when the shaft of the first solenoid 43 retracts, the first lever 49 rotates in the counter-clockwise direction, and the lever 51, the shafts 29, 31 and the support plates 26 all operate in the reverse manner to that described hereinabove, thus moving the figure wheel 32 upwardly. At the same time, the second lever 53 rotates in the clockwise direction and the feed pawl 54 retracts. This retracting movement rotates the ratchet 55 by one pitch. The rotation of the ratchet 55 in turn takes up the wire 59 on drum 58 so that the figure wheel 32 moves one figure to the left in FIG. 2 against the spring 39.

Subsequent to the aforesaid operation, the pulse motor 33 rotates by an angular amount corresponding to the number of the second figure "2" and prints the number of the second figure "2" in the same manner as described hereinabove. Thereafter, the number of the final figure "1" is likewise printed to provide the number "123" on the sheet.

After the number of the final figure "1" is printed to provide the printed number "123" by means of rotation, rocking and movement of the figure wheel 32 in the above-described manner, the second solenoid 61 is actuated by an electric signal and retracts the operation rod 62. Because the operation rod 62 is kept in contact with the sheet-like plate 67 of the short arm 57*b* of release lever 57, the release lever 57 rotates in the counterclockwise direction, whereby the recesses 64, 65 formed on the elongated arm 57*a* come into contact with the pins 54*a* and 56*a* of the feed pawl and brake pawl, respectively, thereby rotating both feed pawl 54 and brake pawl 56 and releasing their engagement from ratchet 55. As a result, the figure wheel 32 returns to the right due to resiliency of the spring 39. Further, because the wire 59 is also pulled to the right, the ratchet 55 rotates in the reverse direction and returns to its original position.

The operation of the first solenoid 43 must be synchronized with that of the pulse motor 33, which may be effected by a suitable electric control circuit (not shown).

If it is desired to print the same number such as "123" a plurality of times in succession, the figure buttons 3, 3 . . . displaying the numbers "1", "2", "3" are first depressed in the same manner as described hereinabove and then the memory button 7 is depressed. Further, the figure button 3 displaying the number of times the number "123" is to be repeatedly printed is depressed and the button 8 for reproducing the memorized number "123" on the display portion 14 is depressed. Finally, the print instruction button 9 is depressed, whereby the number "123" can be printed. When the instruction button is again depressed, the same number "123" is again printed. This procedure is repeated a plurality of times. When printing of the number "123" is printed the desired number of times, the numbering machine is so set as to print a fresh number "124". In other words, after the same number is printed the aforesaid plurality of times, the number to be printed is increased by one.

In order to increase the number to be printed by one whenever printing is effected, it is not necessary to depress the memory button or the like, but instead the starting figure is first set by the figure button and the print instruction button 16 disposed on the upper surface 13*b* of the swelled portion 13 is then depressed.

FIGS. 9 through 12 show the feed mechanism 44 according to a second embodiment of the invention wherein like reference numerals are employed to designate like parts.

In the second embodiment, the feed pawl 54 is rotatably connected to one end 53*b* of the lever 53 and is urged toward the ratchet 55 by the spring 70 so as to constantly engage with the ratchet 55. A recess 71 is formed on the upper surface at the tip of the feed pawl 54.

The brake pawl 56 is rotatably supported substantially at its center by the shaft 48 and is engaged with the ratchet 55 by the resiliency of spring 72. A protuberance 73 (FIG. 11) is formed at one end of the brake pawl 56 so as to project upwardly. The release lever 57 is idly fitted to the shaft of the ratchet 55 in a concentric arrangement with same. The release lever 57 has a substantially elongated configuration, and protuberances 74 and 75 are formed at the tip and rear end thereof, respectively, so as to extend downwardly. An arcuate protuberance 76 having a uniform thickness is formed on the upper surface of the ratchet 55.

Figure 12:
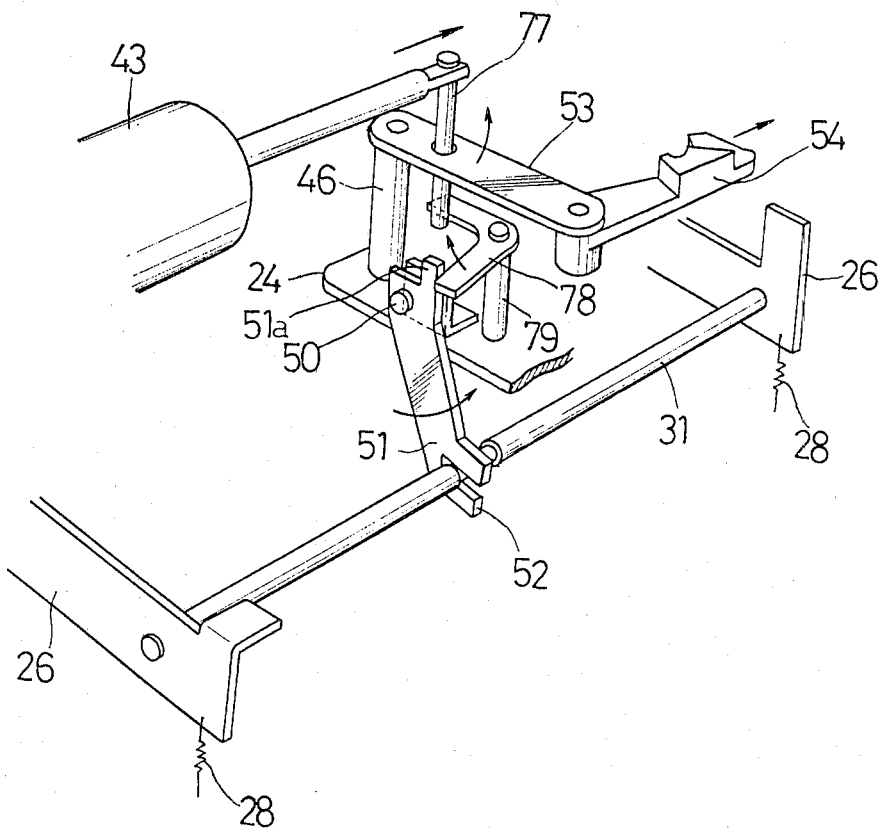
FIG. 12 is a perspective view of the mechanism for rocking the support plates in accordance with the second embodiment of the invention.

As shown in FIG. 12, at the tip of the shaft of solenoid 43 is fixed a rod 77 which extends downwardly past and through the lever 53 for rotating the ratchet 55, and the tip of rod 77 comes into contact with one end of a substantially V-shaped link 78. The link 78 rotates within a horizontal plane around a shaft 76, fitted to the base plate 24. The other end of the link 78 comes into contact with the upper end 51*a* of the lever 51. The lever 51 is in turn pivoted at 50 at the upper portion thereof to the bracket fixed to the base plate 24, and the main body of the lever 51 is so disposed as to be inclined rearwardly downwardly. A recess 52 is formed at the lower end of the lever 51 by a pair of rearwardly projecting protuberances. The shaft 31 supported between the rear ends of the support plates 26, 26 is clamped by recess 52.

During one reciprocating advance and retreat movement of the shaft of the solenoid 43 when the solenoid 43 is actuated, the feed pawl 54 engages with one tooth of the ratchet 55 via the lever 53 and rotates the ratchet 55 by one pitch. When the shaft advances, the support plates 26, 26 rock via the lever 51 and the shaft 31, thereby moving the feed pawl 54 forwardly. When the shaft retreats, the feed pawl 54 rotates both ratchet 55 and drum 58 and moves the figure wheel 32 a distance corresponding to one figure by pulling it with wire 59. Next, when the solenoid 43 is actuated again, the same operation is repeated to print the second digit and move the figure wheel 32 to the next position. These operations are repeated to print twelve figures, for example, and the figure wheel 32 is then returned in the following manner to its original position in order to print the next number.

After the solenoid 43 is actuated and the figure wheel 32 finishes printing the twelfth and final figure, the ratchet 55 is rotated one pitch by the feed pawl 54 in order to move the figure wheel 32 to the position of the 13th figure. In this case, because one uniformly-thick protuberance 76 of the ratchet 55 is anchored to the protuberance 75 at the rear end of the release lever 57, the protuberance 74 at the tip of the release lever 57 engages with the recess 71 of the feed pawl 54 and pushes the feed pawl 54 outwardly. Consequently, pawl 54 is disengaged from ratchet 55. Subsequently, when the shaft of the solenoid 43 advances to thereby print the number of the 13th figure, the feed pawl 54 advances via the lever 53 whereby the tip of the feed pawl 54 comes into contact with the protuberance 73 of the brake pawl 56 and pushes the same so that brake pawl 56 is released. Because engagement of both the feed pawl 54 and the brake pawl 56 with the ratchet 55 are released, the figure wheel 32 returns to its original position while the ratchet 55 and the drum 58 are rotated back by the tensile force of the coiled spring 39 and return to their original position. The ratchet 55 and the drum 58 are held in their original positions because the protuberance 76 rotates and kicks the protuberance 74 at the rear end of the release lever 57 at its one end to thereby release engagement between the protuberance 74 and the recess 71 so that the pawls 54 and 56 again engage with the ratchet 55. Various printing operations can be effected by depressing the instruction buttons disposed on the case 1 in accordance with the second embodiment in the same manner as described hereinabove in connection with the first embodiment of the invention.

Figure 13:
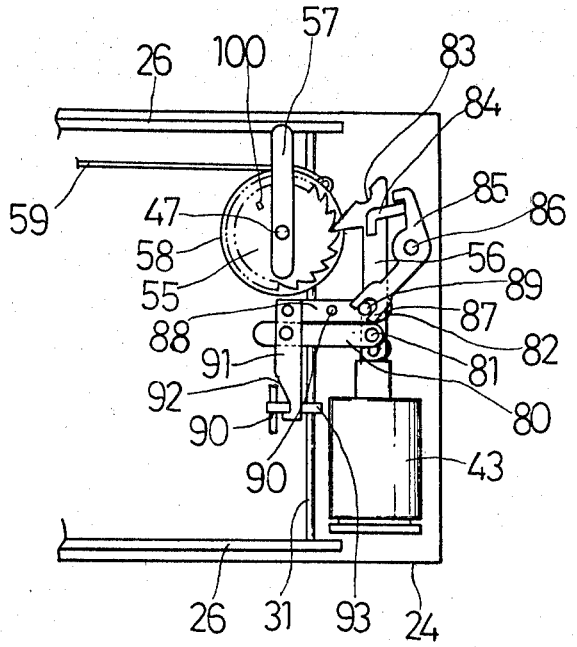
FIG. 13 is a plan view of the feed mechanism in accordance with a third embodiment of the invention.
Figure 14:
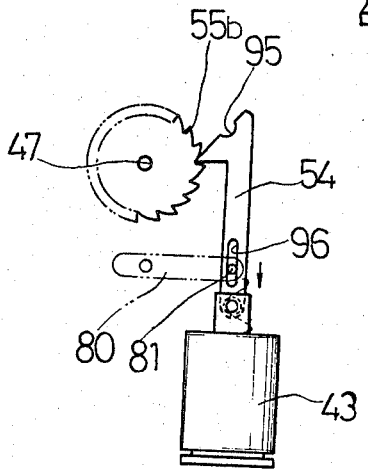
FIG. 14 is a plan view of the principal portions of the feed mechanism in accordance with the third embodiment of the invention.
Figure 15:
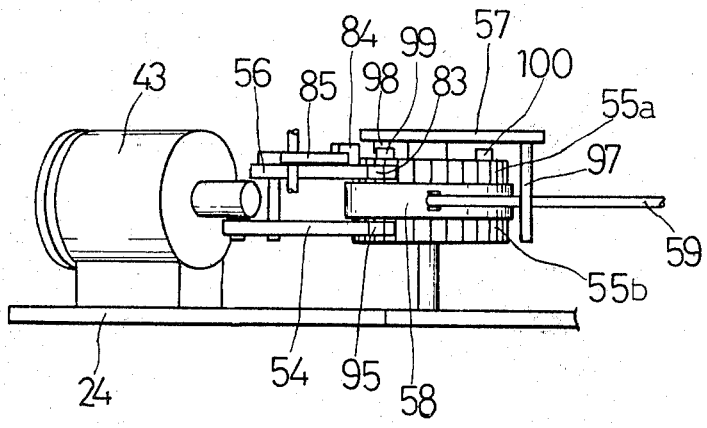
FIG. 15 is a side view of the feed mechanism in accordance with the third embodiment of the invention.

FIGS. 13 through 15 show a third embodiment of the present invention. In this embodiment, the ratchet 55 is divided into upper and lower segments and the upper ratchet 55*a* engages with the brake pawl 56 so as to prevent the ratchet 55 from rotating in a counter-clockwise direction.

The brake pawl 56 is rotatably supported at its lower portion by a link 80 and a shaft 81 and is urged towards the ratchet 55*a* by a spring 82. A hemispherical recess 83 is formed at the upper end of the brake pawl 56. A protuberance 84 is defined on the upper surface of the brake pawl 56 and extends towards the back of the brake pawl 56. The tip of protuberance 84 comes into contact with one end of a substantially inverted V-shaped link 85. The link 85 is rockable around a shaft 86, while the other end thereof clamps at a clamp portion 87 to a protuberance 89 which is formed above one end of a link 88. The link 88 is juxtaposed with the link 80 and is rockable about a support point 90. The other end of the link 88 is connected to still another link 91 whose tip forms a slope 92 and engages with one end of a substantially L-shaped link 93. The other end of the link 93 is connected to the horizontal shaft 31. The link 93 is rockable about its support point 94.

FIG. 14 is a plan view showing a rotary mechanism in the lower ratchet 55*b*. The lower ratchet 55*b* engages with the feed pawl 54 at substantially the same position in the vertical direction as the brake pawl 56. The feed pawl 54 is connected to the shaft of the solenoid 43 at its lower end, and a hemispherical recess 95 is formed at its upper end at substantially the same position as the brake pawl 56. An elongated hole 96 is formed at the center of the feed pawl 54 and the lower end of the shaft 81 is inserted from above into elongated hole 96.

The release lever 57 is disposed in the radial direction above the ratchet 55 concentric with the support pole 47. A rod-like member 97 (FIG. 15) is suspended below one end of the release lever 57 while a protuberance 98 is formed at the other end. Protuberances 99 and 100 are formed on the upper surface of the ratchet 55*a* so as to engage with protuberance 98.

When the shaft of the solenoid 43 retracts from the state shown in FIG. 14, the feed pawl 54 for rotating the drum 58 moves downwardly in FIG. 14, thereby rotating the lower ratchet 55*b* and thus rotating the drum in a clockwise direction. In this instance, the link 80 does not move because it is disposed inside the elongated groove. When the drum 58 rotates in a clockwise direction in the above-described manner, the wire 59 wound on the curved circumferential surface of the drum 58 is pulled and thus moves the figure wheel 32 a distance corresponding to one figure.

With rotation of the lower ratchet 55*b* and the drum 58, the upper ratchet 55*a* also rotates. When the brake pawl 56 is pushed to the right by the teeth of the ratchet 55*a* as shown in FIG. 13, the protuberance 84 of the brake pawl 56 further pushes the link 85 to the right, whereupon the link 85 rotates in the clockwise direction around the shaft 86 and moves the right-hand end thereof upwardly and thus the left-hand end downwardly. As a result, both links 80 and 91 are moved downwardly and the slope 92 at the lower end of the link 91 rotates the L-shaped link 93 in the counter-clockwise direction around the support shaft 94 and lifts up the horizontal shaft 31, thereby causing the figure wheel 32 to carry out the printing operation. Thereafter, the feed pawl 54 is moved upwardly as shown in FIG. 14 by the solenoid 43 while the brake pawl 56 engages with the next tooth. Thus, the brake pawl 56 returns to its original position and printing of the next figure may commence.

After the figure wheel 32 finishes printing the last figure in the above-described manner, the feed pawl 54 and the brake pawl 56 are driven to perform the above-described respective operations by solenoid 43 in order to move to the positions corresponding to the next figure. In this case, the rod-like member 97 of the release lever 57 disposed at the next position to the tooth of the final figure that has been rotating clockwise together with the ratchet 55*a* while it is locked by the protuberance 100 on the upper surface of the ratchet 55*a*, comes into the recesses 83, 95 at the heads of the feed pawl 54 and brake pawl 56, respectively, and the release lever 57 also rotates so that the rod-like member 97 simultaneously releases engagement of both pawls 56 and 54 with respect to the ratchets 55*a* and 55*b*. Accordingly, the drum 58 connected by the wire 59 rapidly rotates in the counter-clockwise direction due to the tensile force of the coiled spring 39 together with both ratchets 55*a*, 55*b*, and the figure wheel 32 moves to the right-hand end of the square shaft 29.

When the figure wheel 32 has almost returned to its original position, the rotating protuberance 100 disposed on the ratchet 55*a* kicks off the protuberance 98 at the rear end of the release lever 57 which has so far been supporting the brake pawl 56 and the feed pawl 54, thereby releasing the engagement between the rod-like member 97 and the recesses 83, 97 of both pawls 56 and 54, respectively. Consequently, the release lever 57 rotates in the counter-clockwise direction and is stopped when protuberance 98 strikes protuberance 99. Thus, the release lever 57 is reset to its original position.

In the third embodiment of the invention, various printing operations may be effected by depressing the push buttons connected to various instruction circuits disposed in the case 1 in the same manner as described hereinabove and connection with the first embodiment of the invention.

Figure 16:
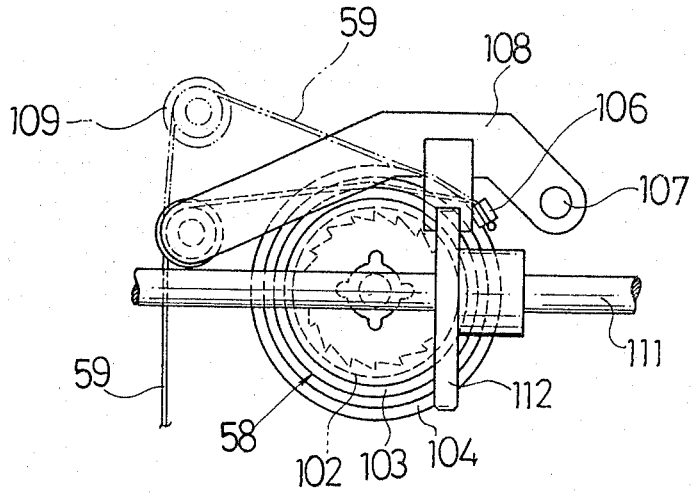
FIG. 16 is a plan view of a winding mechanism employing a multi-staged drum in accordance with a fourth embodiment of the invention.
Figure 17:
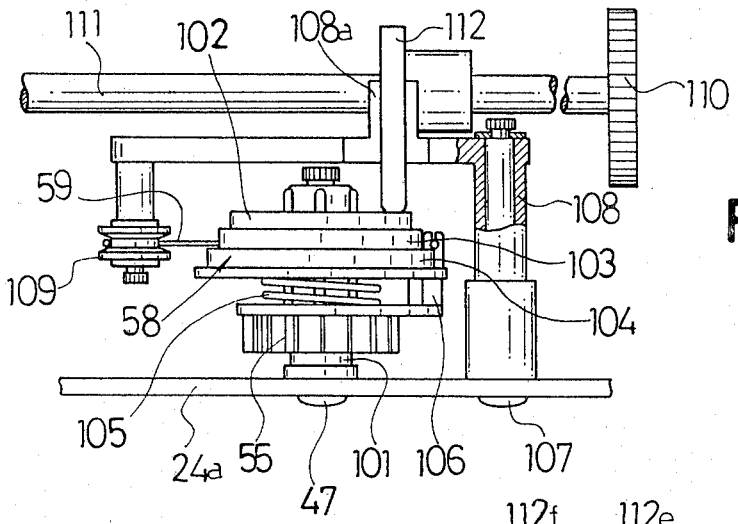
FIG. 17 is a front view of the winding mechanism of FIG. 16.
Figure 18:
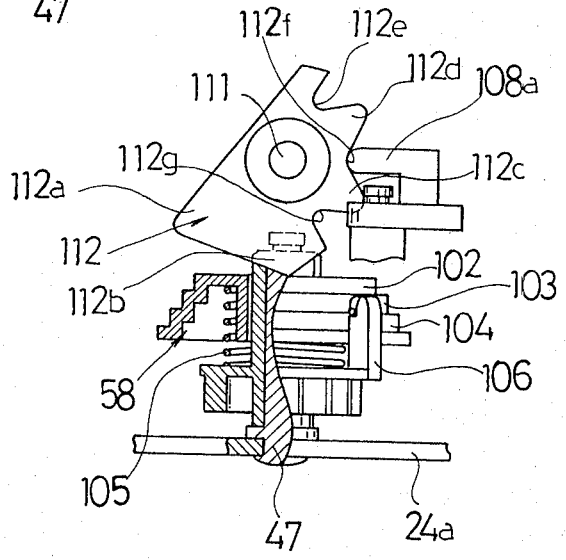
FIG. 18 is a partially cut-away side view of the winding mechanism of FIG. 16.

FIGS. 16 through 18 show a fourth embodiment of the invention which makes it possible to adjust the gaps between the numbers to be adjusted.

In the fourth embodiment of the invention, the ratchet 55 is rotatably fitted to the shaft 47 which is implanted in intermediate base plate 24*a* and a shaft 101 of ratchet 55 is extended upwardly. A multi-staged drum 58 is so fitted to shaft 101 as to be capable of rotating integrally with the ratchet 55 and sliding in the vertical direction. The multi-staged drum 58 comprises a lamination of three drum portions 102, 103, 104 each having different diameters, and is urged upwardly by a spring 105 interposed between the upper surface of ratchet 55 and the lower surface of drum 58.

A slit is formed at a part of the outer circumference of the drum 58 and a protuberance 106 formed at the outer edge portion on the upper surface of ratchet 55 is fitted into such slit. The end of the wire 59 is fixed to protuberance 106. A shaft 107 is implanted in intermediate base plate 24*a* and a transmission lever 108 is rotatably fitted to shaft 107. The intermediate portion of wire 59 is wound around a pulley 109 disposed at the tip of lever 108.

A shaft 111 provided at one end thereof with an operation knob 110 is disposed above the multi-staged drum 58, and a cam 112 having four lobes 112*a*, 112*b*, 112*c* and 112*d* formed thereon is so fitted to shaft 111 as to rotate integrally with shaft 111. Among these lobes of cam 112, the lowermost lobe, such as lobe 112*b* in FIG. 18, for example, comes into contact with the upper surface of the multi-staged drum 58 and pushes it downwardly against the resiliency of the spring 105 so that the wire 59 is wound on a predetermined drum stage.

In the state shown in FIG. 18, when the operation knob 110 is turned to thereby rotate the cam 112 in a clockwise direction, a slide portion 108*a* of transmission lever 108 which comes into sliding contact with the circumference of the cam 112 is pushed to the right by lobe 112*d* in FIG. 18 so that the transmission lever 108 rotates upwardly in FIG. 16 about shaft 107. As a result, the wire 59 comes off the drum portion 103 at the intermediate stage. When cam 112 is further rotated in the clockwise direction, the slide portion 108*a* comes into valley 112*e* of the cam 112 whereby the transmission lever 108 rocks downwardly in FIG. 16 and at the same time, lobe 112*c* of cam 112 comes into contact with the upper surface of the multi-staged drum 58. Because the distance between lobe 112*c* and shaft 111 is shorter than that between lobe 112*b* and shaft 111 in this instance, the multi-staged drum 58 is lifted upwardly by the resiliency of spring 105 and consequently wire 59 is wound on drum portion 104, which has the largest diameter of the three drum portions.

When the ratchet 55 is rotated by one pitch via the aforesaid feed mechanism while the wire 59 is being wound on the largest diameter drum portion 104, the distance the wire 59 is pulled corresponding to this one pitch becomes greater so that the gaps between the numbers to be printed become greater.

When the cam 112 is rotated in the counter-clockwise direction from the state shown in FIG. 18, lobe 112*a* comes into contact with the upper surface of the multi-staged drum 58 and thus the drum 58 is pushed downwardly to a position lower than that shown in FIG. 18. Accordingly, wire 59 is then wound on drum portion 102 having the smallest diameter. In the same manner as described hereinabove, lobe 112*c*, valley 112*g* and slide portion 108*a* of the transmission lever 108 are brought into sliding contact with one another, so that the wire 59 comes off from drum portion 103 and is then wound on drum portion 102. The change-over operation can be reliably effected in this manner.

When wire 59 is wound on drum 102 with the smallest diameter, the length of the wire 59 wound by one pitch of the ratchet becomes shorter so that the gaps between the numbers to be printed also become smaller.

Figure 19:
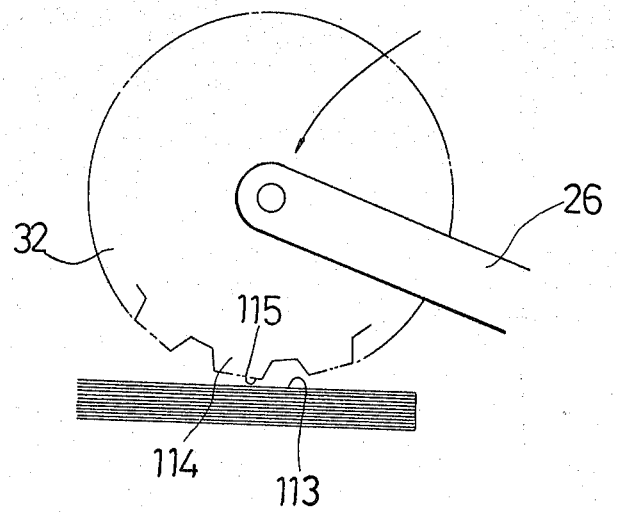
FIGS. 19 and 20 are side views showing the relation between the position of the sheet and a striking angle.
Figure 20:
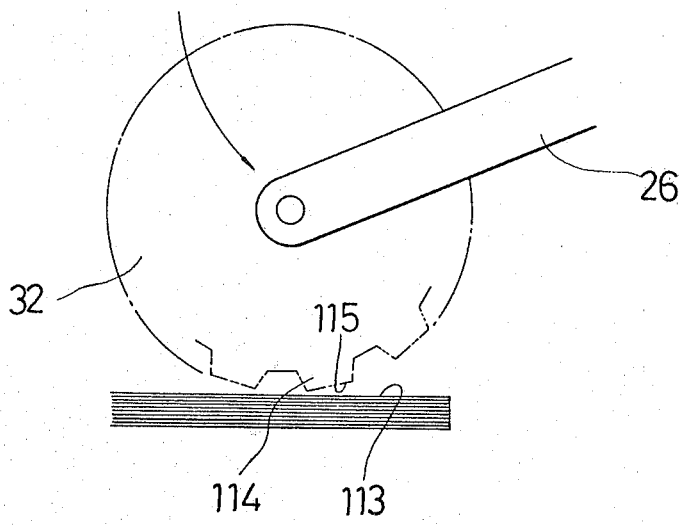

FIGS. 19 through 23 show a mechanism for adjusting the striking angle with respect to the sheet surface. The printing operation in accordance with the present invention is carried out in such a manner that while the sheet is placed below the figure wheel 32, the figure wheel 32 is rotated downwardly by the rocking of the support plates 26 and printing is effected as the figure wheel 32 comes into contact with the sheet. Accordingly, if the sheet surface 113 is relatively high such as shown in FIG. 19, the printing surface 115 of the printing portion 114 formed around the figure wheel 32 is not parallel to the sheet surface 113 so that printing will be non-uniform. If the sheet surface 113 is relatively lower, on the other hand, printing also becomes non-uniform as shown in FIG. 20. It is therefore necessary to rotate figure wheel 32 a considerable amount in the counter-clockwise direction if the sheet surface 113 is higher than the reference position, and to rotate figure wheel 32 a considerable amount in the clockwise direction when the sheet surface 113 is lower than the reference position. For this purpose, the present invention employs the following construction.

Figure 21:
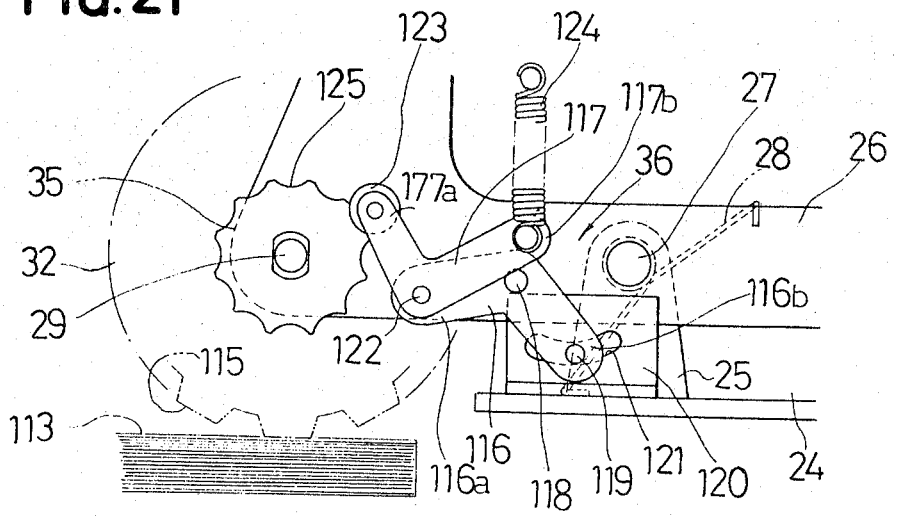
FIGS. 21 through 23 are side views for explaining the operation of a striking angle adjusting mechanism.
Figure 22:
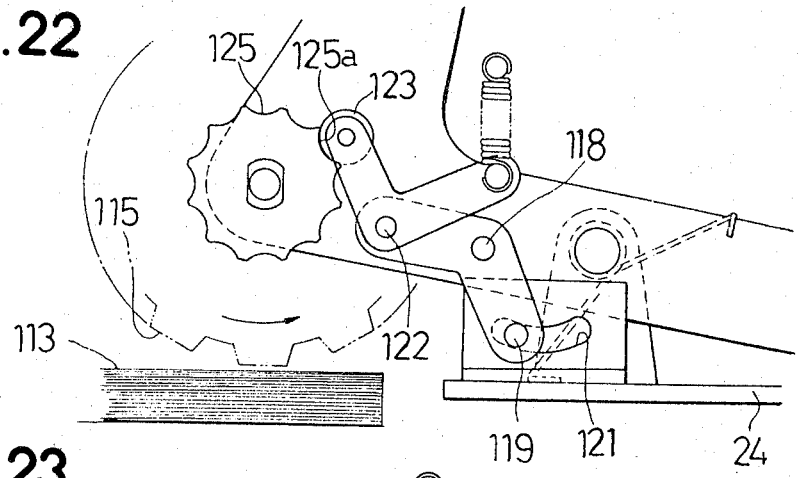
Figure 23:
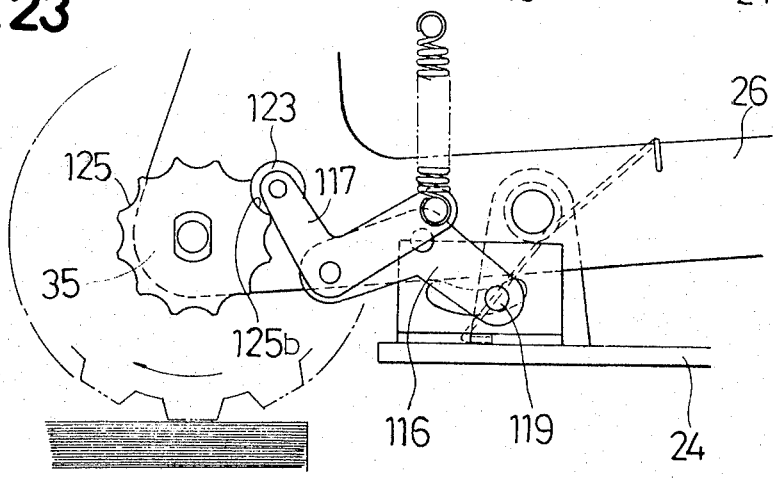

As shown in FIGS. 21–23, gear 35 is fitted to the other end 29*b* of the square shaft 29 and a link mechanism 36 is interposed between gear 35 and the support plate 26. As shown, the link mechanism 36 comprises two levers 116, 117, with lever 116 being pivoted at 118 at the intermediate portion thereof to support plate 26 and the rear end 116*b* thereof is provided with a pin 119 fixed thereto. The pin 119 is anchored to a curved, elongated hole 121 of a bracket 120 fixed to base plate 24. The other lever 117 is pivoted to the forward end portion 116*a* of lever 116 via pin 122, and a roller 123 is fitted to the forward end portion 117*a* of lever 117. A spring 124 is fixed to the rear end portion 117*b* of lever 117. The gear 35 fitted to the square shaft 29 has a plurality of continuous arcuate recesses 125 provided around its outer circumference, with each recess 125 having an arcuate shape conforming with the outer circumference of roller 123. The roller 123 is constantly brought into resilient contact with the outer circumference of the gear 35 by the resiliency of spring 124.

The link mechanism 36 is set in such a fashion that the lowermost surface of the figure wheel 32, when the support plates 26 become substantially horizontal, is the reference surface of strike and the print surface 115, or striking surface, always becomes parallel to the sheet surface 113 even when the practical striking surface becomes higher or lower than the reference striking surface.

When the striking surface is higher than the reference surface of strike, the figure wheel 32 is placed at a considerably rotated position in the clockwise direction as shown in FIG. 19, so that the figure wheel 32 must be rotated in a counter-clockwise direction to some extent to correct its position. Correction is thus made such that the pushing force of the roller 123 acts upon the upper half 125*a* of the recess 125 of the gear 35 and the figure wheel 32 is rotated in the direction of the arrow in FIG. 22, thereby causing the striking angle to be horizontal. When the striking surface is lower than the reference striking surface, correction is made such that the pushing force of the roller 123 acts upon the lower half 125*b* of the recess 125 of the gear 35. Further, when the striking surface is equal to the height of the reference surface of strike, correction is made such that the pushing force of the roller 123 acts uniformly upon the entire surface of recess 125.

The pushing force of the roller 123 is made to act upon one half of the recess 125 by suitably selecting factors such as the position of the pivot 118 of the lever 116, the distance between the pivot 118 and the pins 119, 122, the shape of the lever 117, the shape of the elongated hole 121, etc. More specifically, these factors may be set in such a manner that roller 123 is placed at a position considerably in the counter-clockwise direction from the reference position (the position shown in FIG. 21) when the forward end portions of the support plate 26 is up, and is placed at a position considerably in the clockwise direction when the forward end portion of support plate 26 is down.

As an alternative link mechanism construction, it is possible to employ, for example, an arrangement in which only one lever is used and the shape of the elongated hole is curved from the center and descends from the center to both ends. In other words, the rotary member is slightly rotated in order to constantly have the striking surface parallel to the sheet surface even when the striking surface is considerably deviated in the vertical direction from the reference strike surface.

Figure 24:
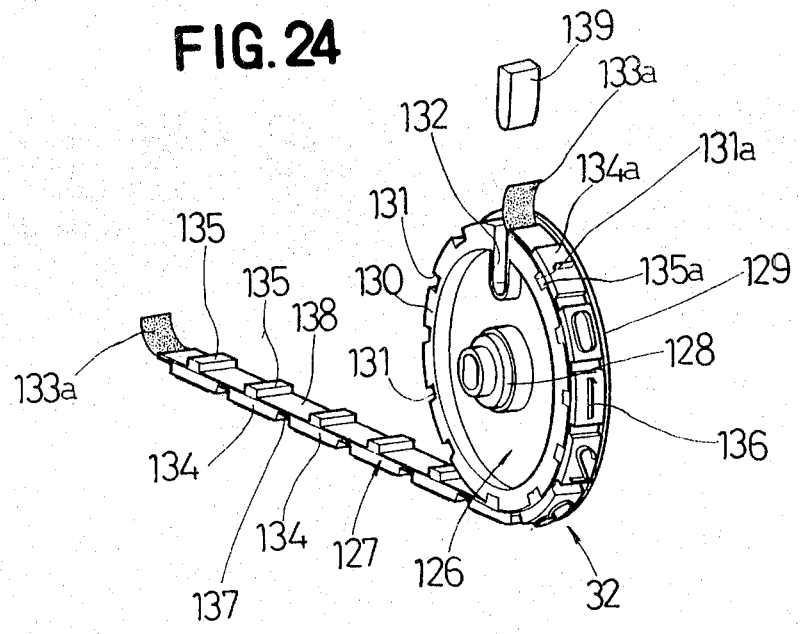
FIG. 24 is a perspective view of a fifth embodiment of the invention in which a portion of the print members is shown fitted to a figure wheel main body.
Figure 25:
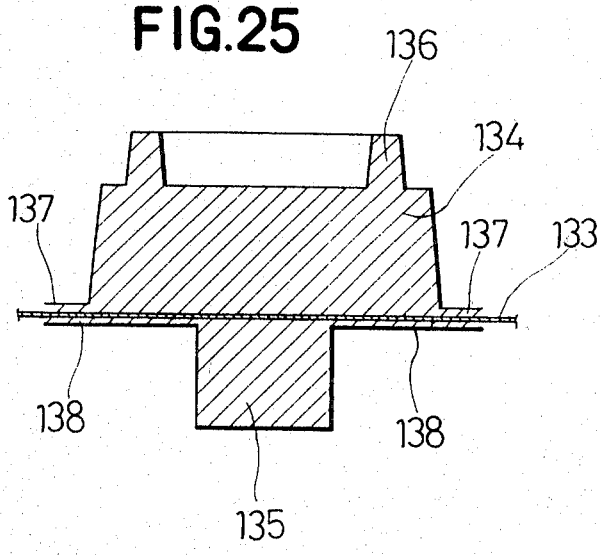
FIG. 25 is a longitudinal sectional side view of a portion of the print members of the fifth embodiment.

FIGS. 24 and 25 show a fifth embodiment of the invention wherein the figure wheel 32 comprises a main figure wheel body 126 and a print member 127 detachably fitted to the main body 126.

The figure wheel main body 126 is provided with a bearing 128 and a support disc 129 provided with a substantially square shaft hole at its center, a ring-like support 130 having a diameter smaller than that of support disc 129 and formed integrally with the same, and a plurality of anchor grooves 131 equidistantly formed on the outer circumference of the support 130 so as to extend in the width direction thereof. An anchor groove 132 having a substantially U-shaped side surface is formed at a position corresponding to one of the anchor grooves 131.

As shown in FIG. 25, the print member 127 comprises a resilient cloth belt 133 having a length considerably longer than the outer circumference of the support 130. A plurality of print blocks 134 are bonded onto the surface of cloth belt 133 and a plurality of engaging protuberances 135 are bonded onto the back of cloth belt 133.

The plurality of print blocks 134 each have print portions on which a number or a symbol is disposed and are integrally continuous with one another at their lower portions, thereby forming a belt with a small thickness as a whole. The gaps 137 between print blocks 134 are equal to one another, or equal to the gaps of the grooves 131.

The plurality of engaging protuberances 135 are provided in the same number as the number of print blocks 134, and are also integrally continuous with one another via connection portions 138 of a small thickness, to form a belt as a whole. The protuberances 135 are also equal to the gaps of the grooves 131 formed on the support 130.

Each engaging protuberance 135 is bonded on the back of the cloth plate 133 at a position corresponding to the center of each print block 134 and, as set forth hereinabove, has a size capable of being pushed into each recess 131.

Although the preferred material forming the print blocks 134 and the engaging protuberances 135 employed in the fifth embodiment of the invention is an elastomer such as a rubber or a plastic material, it is also possible to employ a substantially rigid material such as a metal for only the print blocks 134. If the print blocks 134 are made of the rigid material and the upper surface of the print portion 136 is fairly sharp, multi-copy printing can be effected in a single printing operation by employing a large number of carbon papers. In this case, only the print portion 136 may be made of the rigid material.

In operation of the above-described fifth embodiment of the invention, the engaging protuberance **135*a* of the print block 134*a* at one end of the print member 127 (FIG. 24) is pushed into the recess 131*a* adjacent to the anchor groove 132 of the support portion 130 and the other engaging protuberances 135 are sequentially pushed into the recesses 131. The tips 133*a* of the cloth plate 133 protruding from both ends of print member 127 are fit into anchor groove 132 and a wedge 139 is pushed into the groove from above, thereby fitting the print member 127 onto support 130, or onto the figure wheel main body 126**.

After the print member 127 is thus fitted, another support disc having the same diameter as that of the support disc 129 is fitted onto bearing 128 from outside the ring-like support 130 so that the print member 127 is clamped by the two support discs. The upper surface of the print portion 136 projects considerably from the support discs as viewed from the side, so that printing is possible.

Figure 26:
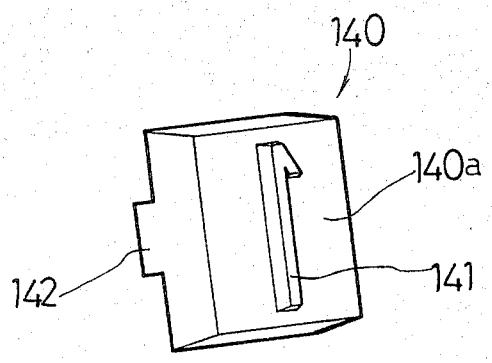
FIG. 26 is a perspective view of a print block in accordance with a sixth embodiment of the invention.
Figure 27:
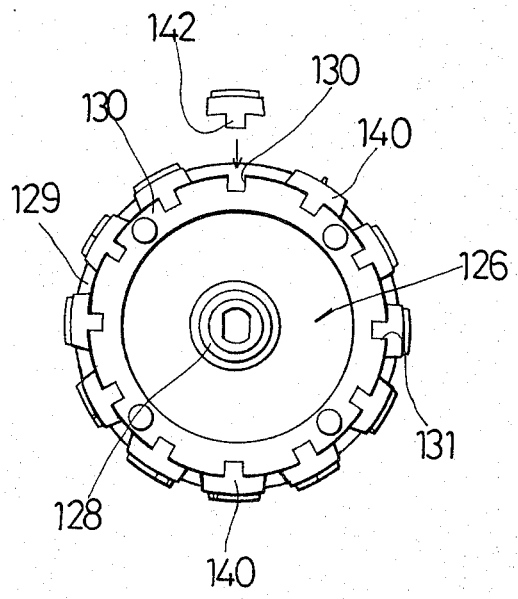
FIG. 27 is a side view wherein the print block of the sixth embodiment is shown fitted to the figure wheel main body.

FIGS. 26 and 27 show a sixth embodiment in accordance with the invention wherein a plurality of blocks 140 forming the print member 127 are constructed as separate members. Each print block 140 has a substantially trapezoidal shape and has a print portion 141 on the upper surface 140 thereof. In the example shown in FIG. 26, the print portion 141 is defined by a protuberance with an inverted "1" shape. An anchoring protuberance 142 is formed on the lower surface of the print block 140 so as to extend in the width direction thereof.

The figure wheel main body 126 comprises the support disc 129 provided with the bearing 128 having the square shaft hole at its center, the ring-like support 130 having a smaller diameter than that of the disc 129 and being formed integrally with the same, and the plurality of engaging grooves 131 equidistantly formed to extend in the width direction on the outer circumference of the support 130. The size of each groove 131 is substantially equal to, or slightly smaller than, the protuberance 142 formed on the print block 140 so that the protuberance 142 can be pushed into the recess 131.

According to the foregoing sixth embodiment of the invention, it is possible to replace only one print member in the same manner as described hereinabove.

Figure 29:
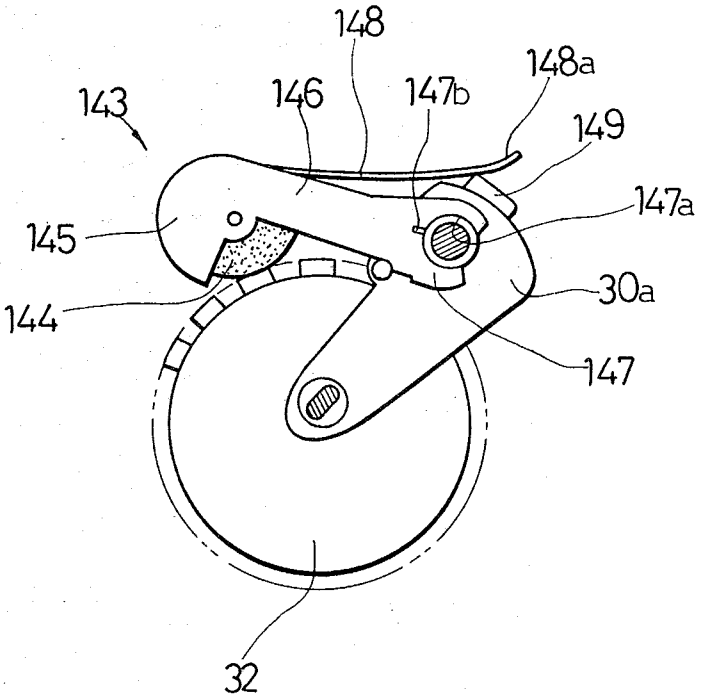
FIG. 29 is a side view of the ink roller device of FIG. 28.
Figure 28:
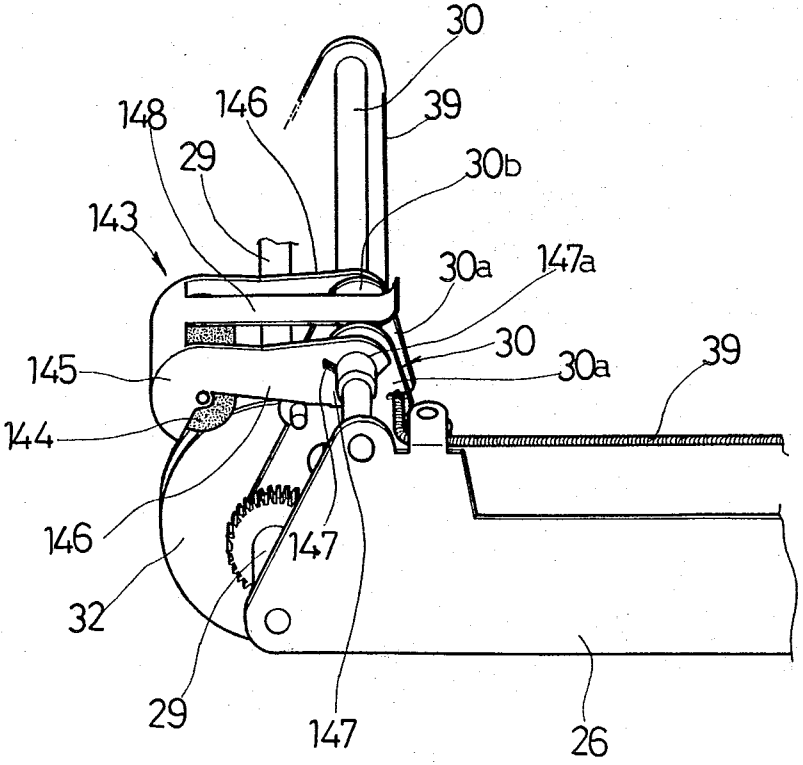
FIG. 28 is a perspective view of a seventh embodiment of the invention wherein an ink roller device is shown fitted to the numbering machine.

FIGS. 28 and 29 show a seventh embodiment of the invention which employs a detachable ink roller. The figure wheel 32 is fitted to the square shaft 29 and the base of the support 38 comprising two support plates **30*a*, 30*a* is fitted to the shaft 30 in such a manner that the tips of the support plates 30*a*, 30*a* clamp the figure wheel 32** therebetween.

A collar **30*b* is interposed between the bases of the support plates 30*a*, 30*a* in order to integrate them together. An ink roller device 143 is fixed to collar 30*b***.

In ink roller device 143, a pair of arm plates 146, 146 extend from both ends of a holder portion 45 which rotatably supports both ends of an ink roller 144, and a resilient portion 147 is formed at the tip of each arm plate 146. The resilient portion 147 comprises a substantially annular slit **147*a* and a small slit 147*b* formed at a part of the slit 147*a*. A tongue-like spring plate 148 extends from the center portion of the holder 145 in the same direction as the arm plate 147 and the extending end 148*a*** thereof is upwardly curved.

In the seventh embodiment, when the ink roller device 143 is pushed from outside (from the left-hand direction in FIGS. 28 and 29) in such a manner that the resilient portion 147 is brought into contact with the collar 30*b*, the slit 147*a* of the resilient portion expands and snaps onto the collar 30*b*. In this case, the small slit 147*b* assists expansion of the slit 147*a*.

When the resilient portion 147 is fitted, the extending end 148*a* curved upwardly from the spring plate 148 rides on the protuberance 149 formed on the collar 30*b* which comes into contact with the lower surface of the spring plate 148. Because the protuberance 149 projects upwardly to some extent, the resiliency of the spring plate 148 acts to push up its extending end 148*a*, so that the holder portion 145 of the ink roller device is pushed downwardly and the ink roller 144 supported by the holder portion 145 comes into resilient contact with the figure wheel 32.

As apparent from the foregoing description, in accordance with the present invention the rocking operation and moving operation of the figure wheel in the direction of the figure by the operation of one solenoid, the rotary operation of the figure wheel a predetermined angular amount by the pulse motor, and the return operation of the figure wheel to its original position by the release member are efficiently combined with one another so that a series of numbers can be continuously printed using one figure wheel, and thus the numbers can be printed rapidly. Further, printing can be effected on any type of sheet by simply placing the numbering machine on the sheet.

Although there have been described what are at present considered to be the preferred embodiments of the invention, it will be understood that various modifications may be made therein without departing from the spirit or essential characteristics thereof. The present embodiments are therefore to be considered in all respects as illustrative, and not restrictive. The scope of the invention is indicated by the appended claims rather than by the foregoing description.

We claim:

1. In an electric hand numbering machine, including:

a pulse motor;

a pair of support plates;

a driven shaft operatively connected with said pulse motor so as to be rotated thereby, said driven shaft being carried by said pair of support plates;

a figure wheel fitted to said driven shaft and rotating integrally with said driven shaft upon rotation thereof are said pulse motor;

a drum;

means operatively cooperating with said drum for rotating said drum;

means operatively cooperating with said drum for sliding said figure wheel along said driven shaft, to a print position when printing and to an original position after printing, by rotation of said drum in opposite directions, respectively;

means for rocking said pair of support plates, said rocking means including actuating means and a connecting mechanism operably interconnecting said actuating means with said support plates so as to rock said support plates and said driven shaft carried thereby, and to in turn rock said figure wheel fitted to said driven shaft against a surface of a sheet to effect printing;

electric control circuit means for controlling an operation of said means for sliding said figure wheel and an operation of said means for rocking said pair of support plates; and an ink roller device operatively cooperating with said figure wheel, the improvements wherein:

said means for rocking said support plates is provided with means operatively cooperating with said driven shaft and said support plates for minutely rotating said figure wheel in accordance with the rocking angle of said support plates so as to maintain parallelism between the surface of a printing figure of said figure wheel and said surface of said sheet to be printed; and said pulse motor is fixed to one of said pair of support plates such that a driving shaft of said pulse motor is disposed substantially coaxially with the axis of rocking movement of said pair of support plates.

2. An electric hand numbering machine according to claim 1, wherein:

said means for maintaining parallelism comprises a gear integrally fitted to said driven shaft and a link mechanism interposed between said gear and said support plates;

said gear is provided with a plurality of continuous arcuate recesses extending around the periphery thereof;

said link mechanism includes at least one lever having a first portion which is pivotably connected to one of said support plates and a second portion which is anchored with respect to said support plates; and said link mechanism further includes a member supported by said lever and resiliently contacting said recesses of said gear so as to minutely rotate said gear in accordance with the rocking angle of said support plates.

3. An electric hand numbering machine according to claim 1, wherein:

said drum has a multi-staged configuration formed of a plurality of drum portions, said drum portions having respectively different diameters;

a tensile wire member operatively cooperates at one end thereof with said drum so as to be wound on any respective one of said drum portions, and operatively cooperates at the other end thereof with said figure wheel so as to move said figure wheel with respect to the figure position thereof in response to winding of said tensile wire member on one of said drum portions; and the length of said tensile wire member wound on any one of said drum portions varies with the diameter of said drum portion so as to permit adjustment of the gaps between the figures to be printed.

4. An electric hand numbering machine according to claim 1, wherein:

said figure wheel comprises a figure wheel main body provided with a groove, and a plurality of print blocks; and each of said print blocks has a printing figure provided on the front thereof and a portion engaging with said groove of said figure wheel main body on the back thereof such that said print blocks are selectively individually detachable from said figure wheel main body.

5. An electric hand numbering machine according to claim 4, wherein:

said figure wheel main body is provided with a plurality of said grooves; and said engaging portions provided on the backs of said print blocks engage with respective ones of said grooves.

* * * * *